United States Patent [19]

Dropczynski

[11] 4,408,727

[45] Oct. 11, 1983

[54] METHOD AND APPARATUS FOR THE AUTOMATIC SEVERING AND REATTACHMENT OF A WEB

[75] Inventor: Hartmut Dropczynski, Konstrukteur, Fed. Rep. of Germany

[73] Assignee: Jagenberg Werke AG, Dusseldorf, Fed. Rep. of Germany

[21] Appl. No.: 140,052

[22] Filed: Apr. 14, 1980

[30] Foreign Application Priority Data

May 22, 1979 [DE] Fed. Rep. of Germany ..... 2920707

[51] Int. Cl.[3] ..... B65H 17/12; B65H 19/26

[52] U.S. Cl. ..... 242/56 R; 242/66

[58] Field of Search ..... 242/56 R, 56 A, 56 B, 242/66, 74, DIG. 3, 56.6, 56.8

[56] References Cited

U.S. PATENT DOCUMENTS

| | | | |
|---|---|---|---|
| 2,585,226 | 2/1952 | Christman | 242/74 X |
| 3,633,839 | 1/1972 | Clark | 242/56 R |
| 3,746,271 | 7/1973 | Frankel | 242/74 X |
| 3,869,095 | 3/1975 | Diltz | 242/56 R |
| 3,918,654 | 11/1975 | Okubo et al. | 242/56 R |

*Primary Examiner*—John M. Jillions

*Attorney, Agent, or Firm*—Sprung, Horn, Kramer & Woods

[57] ABSTRACT

A method and an apparatus for the severing and reattachment of a web wherein the web is severed and the new head of the web so formed is attached to a core which is wound on two driven support rolls between which the web runs, includes the web being held to the circumference of one support roll by suction, severing the web downstream of the held portion when the web is in the held position condition, removing the finished roll, inserting a new core with a pressure roll and contact therewith and adhering the new head end of the web by previously applying an adhesive to either the head end of the web or the core and removing the suction as winding of the core is started.

11 Claims, 6 Drawing Figures

METHOD AND APPARATUS FOR THE AUTOMATIC SEVERING AND REATTACHMENT OF A WEB

BACKGROUND OF THE INVENTION

The invention relates to a method and an apparatus for the automatic severing and reattachment of a web.

When a finished roll is taken off, the web must be severed. After the finished roll has been removed, the new head end of the web is attached to the circumference of a new core, which is wound on two driven support rolls between which the web runs.

In the prior-art methods and apparatuses disclosed in German Pat. No. 21 18 963 and German patent applications DOS Nos. 20 32 724, 27 09 684 and 26 38 368 which deal with this problem, the web is severed only after the finished roll has been lifted off or moved away from the pair of support rolls. Now when a finished roll is lifted off before the web has been severed, the latter often tears at a point where this is not desired, and of course the torn edges are jagged. Complicated manipulations are then required to straighten the head end of the web and attach it to the core.

For attachment of the head end of the web to the new core, glue is applied to the web end in German patent No. 21 18 963; a special fastener is used in German patent application DOS No. 27 09 684; or then an adhesive such as glue is applied to the core.

SUMMARY OF THE INVENTION

The object of the present invention is to provide a method and an apparatus whereby a clean cut can be made through the web when a roll has been finished, the risk of unintentional tearing of the web being eliminated, and whereby the head end of the web can be attached to the new core automatically and without undue loss of time.

In accordance with the invention, this object is accomplished by a method of the type outlined above which is characterized in that the web is held to the circumference of a support roll by suction due to a vacuum produced therein, and is severed in that condition on the support roll; that the finished roll is removed, a new core is inserted, the pressure roll is placed thereon, and the new head end of the web is adhered thereto, adhesive having first been applied either to the head end of the web or to the core; and that the winding of the core is then started, the vacuum being broken once the head end of the web is caught between the support roll and the freshly inserted core. The essential characteristics of the invention are that the web is severed on the circumference of one of the two support rolls, and that while being severed it is held to said circumference by means of a vacuum, so that as the finished roll is taken off the newly formed head end of the web adheres to the support roll at a particular point thereon. After adhesive has been applied either to the head end of the web or to the core, the web end is attached to the new core in known manner, and winding can then be resumed in short order after the vacuum in the support roll has been broken.

The web can be severed while the machine is running at low speed or while it is stopped in the cutting and winding position. However, it is also contemplated, in accordance with the invention, that the web be severed while the support roll is in a first predetermined position, and that the head end of the web be adhered to the core with the support roll in a second predetermined position. This makes it possible to locate the severing means at a readily accessible point, usually below the support rolls, which has the advantage over severing means disposed above the support rolls, as known from German patent 21 18 963 and German patent application DOS 20 32 724, for example, that there is sufficient space to accommodate the severing means, which is not the case when the latter is located in proximity to the wedge between the support rolls. Especially when the finished roll still is not far enough removed from the support rolls, the wedge space is very small and difficultly accessible. In accordance with a preferred embodiment of the method of the invention, the web is therefore severed in the first position on the lower portion of the circumference of the support roll, and as the latter continues to rotate the head end of the web passes into the wedge between the support rolls and into the second position, there to be adhered to the core.

In accordance with a further preferred embodiment of the method of the invention, the core, provided along a generatrix with adhesive, and preferably a length of double-faced adhesive tape, is placed on the support roll in such a way that the adhesive tape is directed downwardly. As the two support rolls continue to rotate, the adhesive tape on the core then comes into contact with the head end of the web, with the latter then adhering to it. Starting a new roll entails practically no loss of time; the setup time is reduced to removal of the finished roll and insertion of a new core. In another method, known from the patents or patent applications cited above, extra time is needed for attaching the head end of the web to the circumference of the core.

The same effect is obtained when in accordance with a preferred alternative of the method of the invention an adhesive is applied to the head end of the web, preferably as the web is being severed. This, too, may be done in the area below the support rolls, where there is sufficient room to accommodate the severing and adhesive-applying means. Applying the adhesive to the head end of the web rather than to the core offers the advantage that the new core can be placed on the support rolls in any position. No fouling of the apparatus by the adhesive will then occur.

The apparatus for the practice of the method of the invention is characterized by a pair of support rolls, of which the roll around part of whose circumference the web is wrapped is provided over a portion of its circumference with suction orifices and connected to a means for producing a vacuum in its interior.

In accordance with an advantageous embodiment of the apparatus of the invention, the support roll having suction orifices is provided with means for arresting it in a first and a second predetermined position. In the first of these positions, the web is severed on the circumference of the support roll, and in the second position the newly formed head end of the web is adhered to the new core.

In accordance with a further advantageous embodiment of the apparatus of the invention, the circumference of the support roll having suction orifices is provided with an axial slot, to be partially penetrated by the web severing means actuated while the support roll is arrested in the first position. Said slot is preferably disposed ahead of the circumferential portion of the support roll which is provided with suction orifices, viewed in the direction of rotation of the support roll, so that the head end of the web newly formed upon the severing of the web is held to the support roll over a relatively large portion of its circumference by suction.

BRIEF DESCRIPTION OF THE DRAWINGS

The method and apparatus in accordance with the invention will now be explained in greater detail with reference to the accompanying drawings which are illustrative of embodiments thereof and wherein.

DETAILED DESCRIPTION OF THE INVENTION

Figure 1:
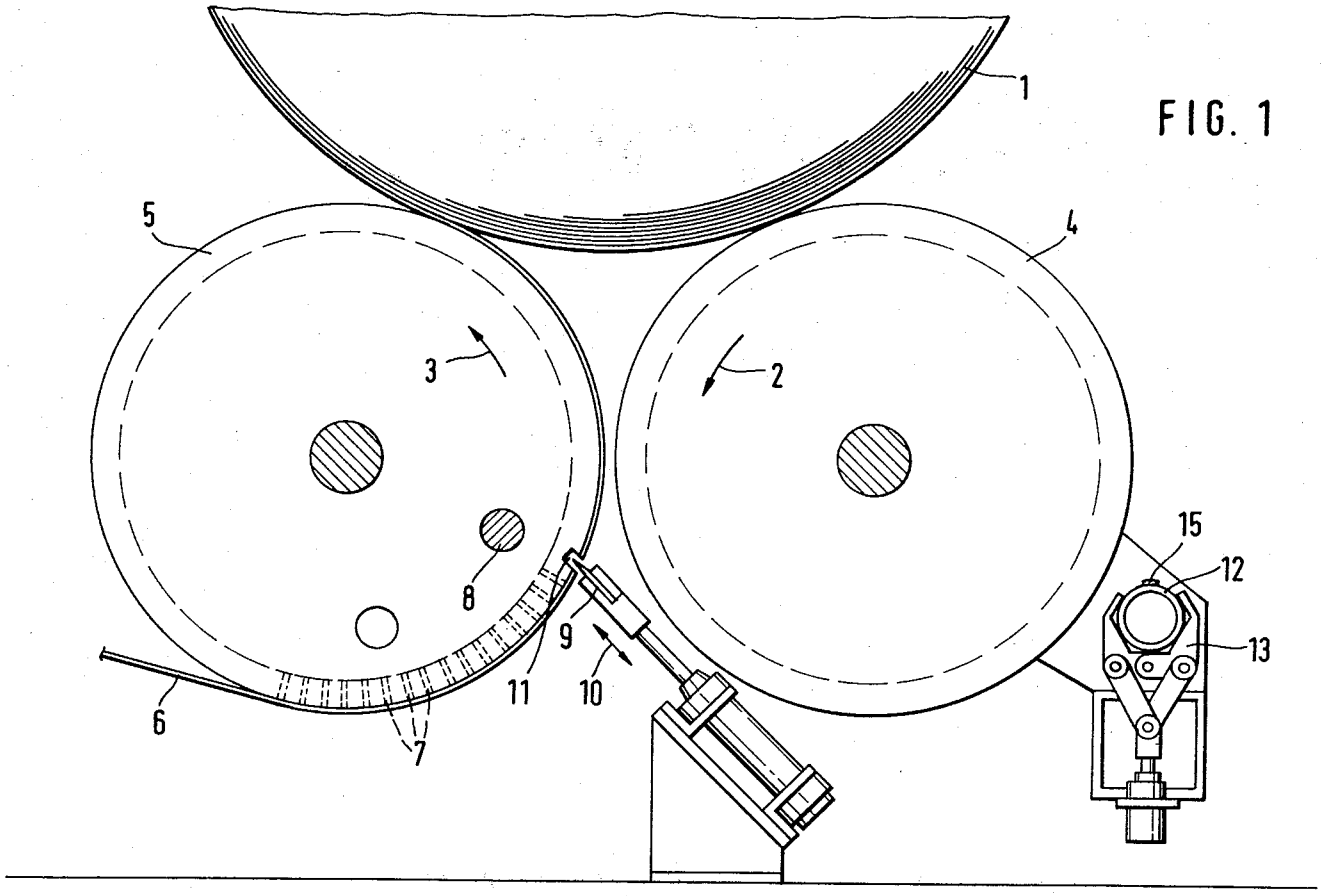
FIGS. 1 to 5 show schematic side views of the apparatus of the invention in the various steps in the practice of the method of the invention, identical parts in the figures being designed by identical reference numerals.

In the position shown in FIG. 1, the finished roll 1 rests on the pair of support rolls 4 and 5, driven in rotation in the direction of the arrows 2 and 3. The support roll 5, over a portion of whose circumference the web 6 is wrapped, is provided with radial suction orifices 7 and with means (not shown) for producing a vacuum in its interior. The roll 1 having been finished, the support roll 5 is rotated into the position shown in FIG. 1, in which it may be held by an engageable pin 8. In place of that pin, other suitable locking means, and in particular mechanical and optical means, may be employed. When the vacuum-producing means is activated, a vacuum is produced in the support roll 5 whereby the web 6 is subjected to suction over the portion of the circumference of the support roll in which the suction orifices 7 are disposed and thus is held to the circumference of the support roll 5.

Figure 2:
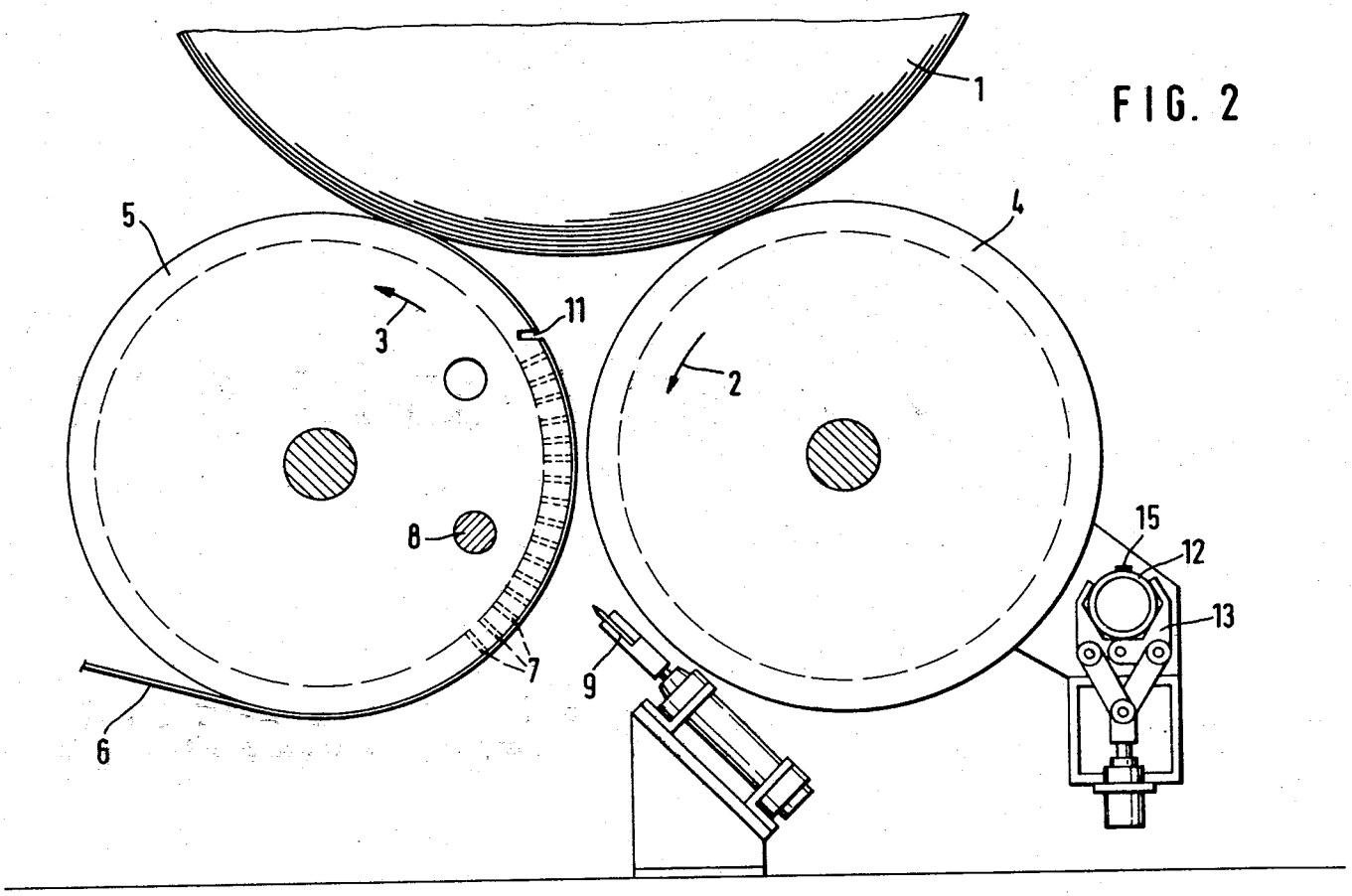
Figure 3:
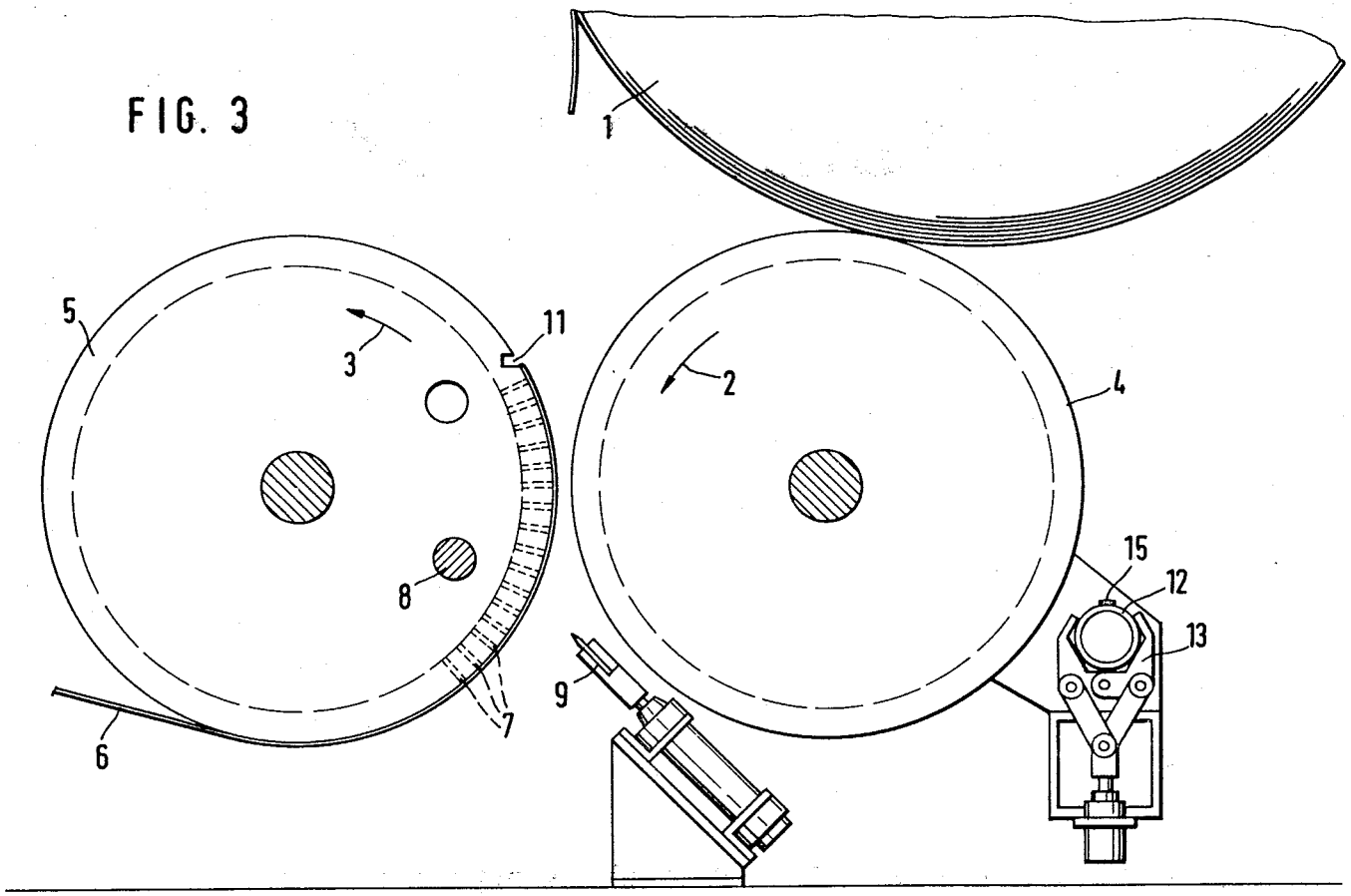
Figure 4:
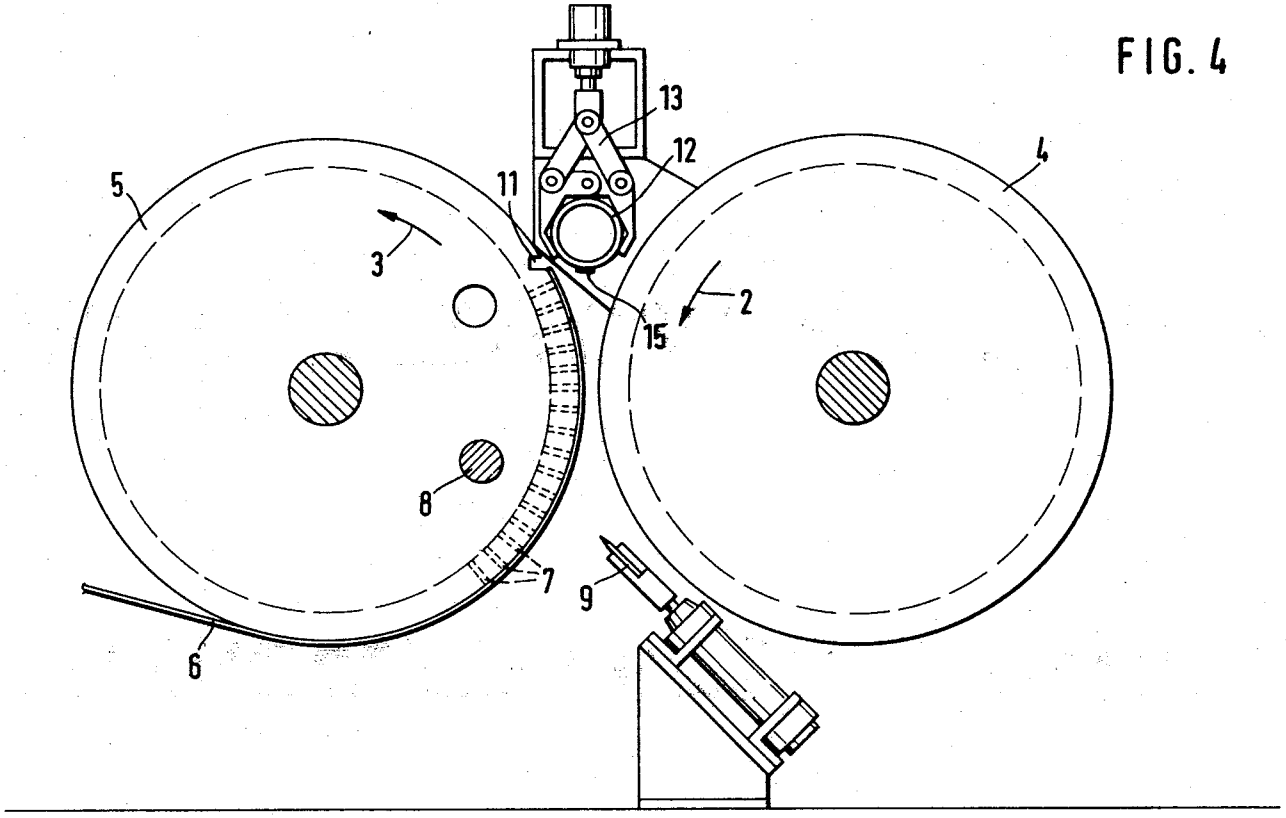
Figure 5:
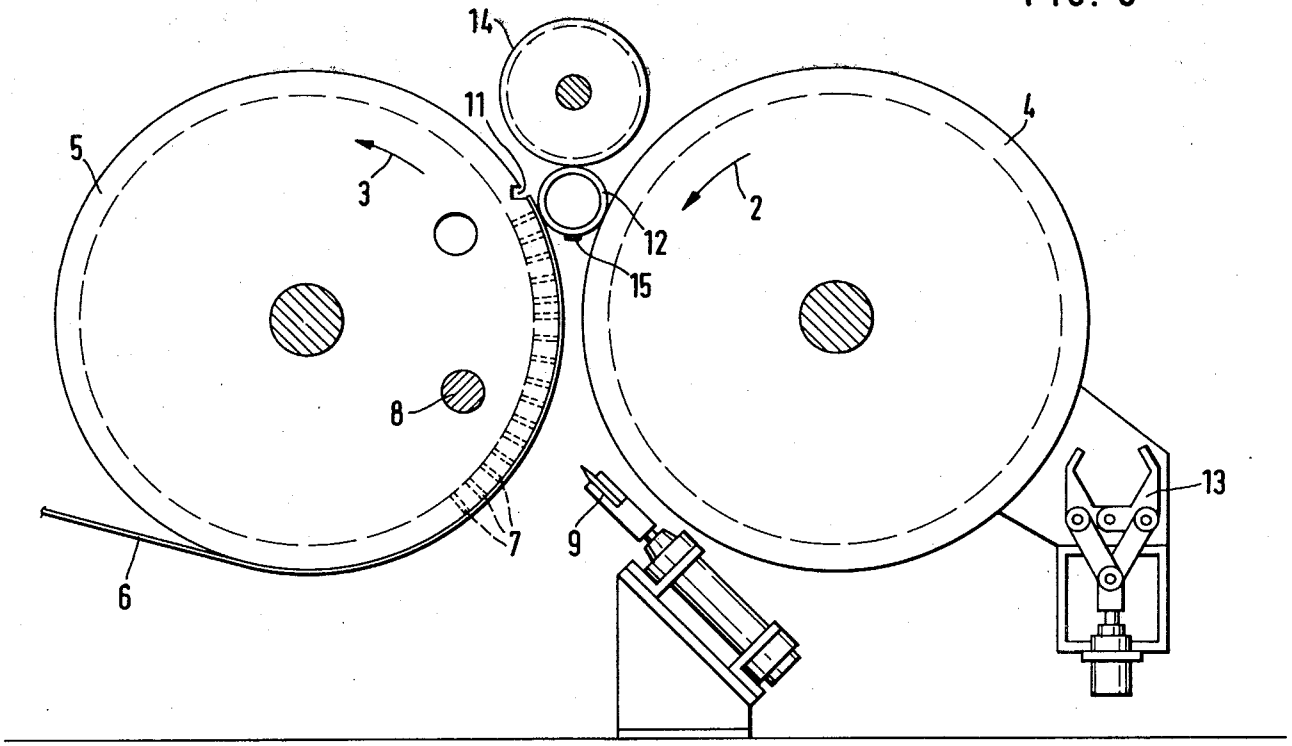

The web 6 is severed by a suitable severing means 9, such as a knife adapted to reciprocate in the directions indicated by the arrows 10 and to partially penetrate the axial slot 11 in the circumference of the support roll 5. As the two support rolls 4 and 5 continue to rotate, the tail end of the web 6 is laid onto the finished roll 1, and the head end of the web newly formed upon the severing of the web 6 reaches the area of the upper wedge between the support rolls 4 and 5. This position is shown in FIG. 2. The pin 8 may then be engaged to lock the support roll 5 in this position, in which the finished roll 1 is taken off the two support rolls 4 and 5, as shown in FIG. 3. A new core 12 is then put in place in the upper wedge between the support rolls 4 and 5, as shown in FIG. 4. This may be done with the aid of a suitable pivoted clamping device 13. After the latter has been swung out of the way, the pressure roll 14 is placed on top of the core 12 (FIG. 5), following which the vacuum in the interior of the support roll 5 can be broken since the head end of the web 6 now is caught between the surface of the support roll 5 and the core 12. As the support rolls 4 and 5 continue to rotate in the directions of the arrows 2 and 3, the lockpin 8 having been released, the head end of the web 6 is adhered to the core 12, and the web 6 is gradually wound onto the core 12.

The adhesive, such as a length of adhesive tape 15, may be applied to the core 12 already while it is in the waiting position. (FIG. 1.) The core is then placed in the upper wedge between the support rolls 4 and 5 with the adhesive tape 15 directed downwardly. (FIG. 4.) As the support rolls 4 and 5 begin to rotate, the adhesive tape 15 comes into contact with the head end of the web 6 and causes it to adhere to the core 12. Alternatively, an adhesive may be applied to the head end of the web 6 as the web is being severed in the position shown in FIG. 1. This may be a liquid adhesive or likewise a length of adhesive tape. The advantage of this is that the core 12 can then be placed into the wedge between the support rolls 4 and 5 in any position.

Since the web 6 is severed with the finished roll 1 still in place on the support rolls 4 and 5, uncontrolled tearing of the web 6 is effectively prevented. All operations, such as severing the web 6, applying the adhesive, moving the finished roll 1 out of the way, inserting the new core 12 and adhering to it the head end of the web, may be automated, which will considerably reduce the down time of the winding machine due to the changeover.

Figure 6:
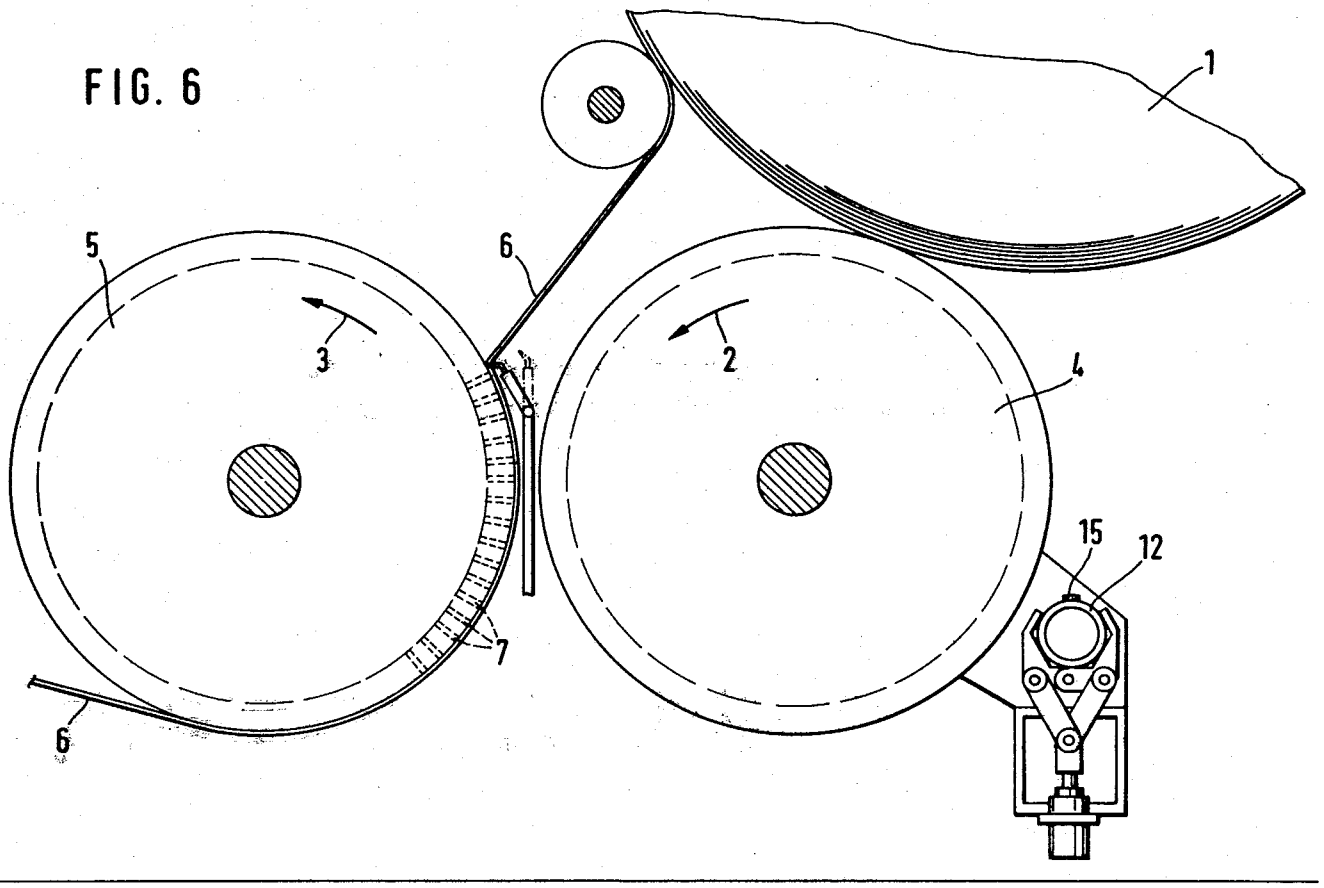
FIG. 6 shows a schematic side view of a further embodiment of the apparatus of the invention.

The web can be severed also at a point on the circumference of the support roll 5 other than that shown in FIGS. 1 to 5. This is done in the case of the further embodiment shown in FIG. 6. When the first suction orifices 7, viewed in the direction of rotation of the support roll 5, have reached the wedge between the support rolls 4 and 5, the machine is stopped. Before the finished roll 1 is lifted off the support rolls 4 and 5, a perforating comb, for example, is inserted from below, for example, in the wedge between said rolls and pressed against the web 6. When the finished roll 1 is then lifted off the support roll 5, the web 6 will tear cleanly along the perforated line on the comb. The latter is then retracted into its starting position. After a new core 12 has been inserted, the pressure roll 14 has been placed on top of it, and the vacuum has been broken, the machine can be promptly restarted. The machine may also be operated continuously if a new core 12 is introduced from the side before the web 6 is severed and the severing of the latter is effected on the slower-turning support roll 5.

It will be appreciated that the instant specification and claims are set forth by way of illustration and not limitation, and that various changes and modifications may be made without departing from the spirit and scope of the present invention.

What is claimed is:

1. In a method for the severing and reattachment of a web of the type wherein the web is severed and the new head end of the web so formed is attached to a core which is wound on two driven support rolls between which the web runs, the improvement comprising the steps of: holding the web to the circumference of one support roll by suction; severing the web downstream of the held portion when the web is in the held condition; removing the finished roll; inserting a new core with a pressure roll in contact therewith; and adhering the new head end of the web by previously applying an adhesive to one of the head end of the web and to the core and removing the suction as winding of the core is started; wherein the one support roll is stopped in a first predetermined position, the web is severed in the first predetermined position of the support roll, the support roll is rotated to a second predetermined position and the head end of the web is adhered to the core when or after the support roll is in the second predetermined position and wherein the web is severed in said first predetermined position on the lower portion of the circumference of the support roll and the head end of the web is led, through continued rotation of the support roll before the new core is inserted in the wedge between the support rolls, into the second position for being adhered to the core.

2. The method according to claim 1, wherein the core is provided with an adhesive along a generatrix which is downwardly directed when the core is placed in contact with the pressure roll.

3. The method according to claim 1, wherein an adhesive is applied to the head end of the web as the web is being severed.

4. The method according to claim 2 or claim 3, wherein the adhesive comprises double-faced adhesive tapes.

5. In a web winding apparatus having a pressure roll and two driven support rolls between which a core is received for winding a web thereon received between the support rolls and wherein the web is severed and reattached to a new core upon the finishing of a roll, the improvement comprising: controllable means for temporarily holding the web to one support roll; means for severing the web downstream of the held portion when the web is in the held condition; and means for effecting the adhering of the web to a new core upon the release by the holding means of the web; wherein the holding means comprises suction surfaces in a portion of the circumference of the one support roll and means for connecting the orifices to a vacuum to produce a suction force, wherein the means for severing includes means for stopping the one support roll in a first predetermined position wherein the holding means is controlled to hold the web, an axial slot in the circumference of the one support roll and a web cutter actuatable when the one support roll is in said first predetermined position to partially penetrate the slot.

6. The apparatus according to claim 5, wherein the web cutter is disposed below the support rolls.

7. The apparatus according to claim 5, wherein the means for effecting adhering comprises means for stopping the one support roll in a second predetermined position angularly displaced from the first predetermined position and for effecting the adhering when the support roll is in the second predetermined position.

8. The apparatus according to claim 7, wherein the means for effecting adhering comprises means for applying adhesive to the head end of the web disposed below the support rolls.

9. The apparatus according to claim 8, wherein the operations of the severing means and of the adhesive-applying means are coordinated.

10. In a dual support-roll winding machine having means for inserting a core tube into the wedge formed between the support rolls, wherein one support roll around part of which the web is wrapped is provided with suction openings over its circumference and is connected to means for producing a vacuum in said one support roll, and web severing means movable from below the support rolls through the gap therebetween into the upper wedge formed between them, the improvement wherein the severing means comprises means for pressing, in the area of the upper wedge formed between the support rolls, against the web which is partly wrapped around the one support roll.

11. The apparatus according to claim 10, wherein the pressing means comprises a perforating comb.

* * * * *